US009248933B2

(12) United States Patent
Spivey, Sr. et al.

(10) Patent No.: US 9,248,933 B2
(45) Date of Patent: Feb. 2, 2016

(54) CARTON WITH HANDLE

(71) Applicant: Graphic Packaging International, Inc., Atlanta, GA (US)

(72) Inventors: Raymond R. Spivey, Sr., Mableton, GA (US); Jean-Manuel Gomes, Acworth, GA (US); Colin P. Ford, Woodstock, GA (US); Li Wei Yang, Shanghai (CN)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/176,546

(22) Filed: Feb. 10, 2014

(65) Prior Publication Data

US 2014/0224864 A1 Aug. 14, 2014

Related U.S. Application Data

(60) Provisional application No. 61/850,238, filed on Feb. 11, 2013.

(51) Int. Cl.
*B65D 5/462* (2006.01)
*B65D 5/46* (2006.01)
(Continued)

(52) U.S. Cl.
CPC ..... *B65D 5/46088* (2013.01); *B65D 5/4204* (2013.01); *B65D 5/542* (2013.01)

(58) Field of Classification Search
CPC ..... B65D 5/46088; B65D 5/46096; B65D 5/46014; B65D 5/46112; B65D 5/4612; B65D 5/46128; B65D 5/14136; B65D 5/46144; B65D 5/46152; B65D 5/46168; B65D 5/46176; B65D 5/4616
USPC ..... 229/117.13, 117.14, 117.15, 117.22; 206/141, 427
See application file for complete search history.

(56) References Cited

U.S. PATENT DOCUMENTS 1,253,193 A 1/1918 Hill
1,624,439 A * 4/1927 Senat ..... 229/117.14
(Continued)

FOREIGN PATENT DOCUMENTS

CA 877792 8/1971
CA 2 160 145 9/1995
(Continued)

OTHER PUBLICATIONS

International Search Report and Written Opinion for PCT/US2014/015526, dated Nov. 19, 2014.
(Continued)

*Primary Examiner* — Gary Elkins
(74) *Attorney, Agent, or Firm* — Womble Carlyle Sandridge & Rice, LLP

(57) ABSTRACT

A carton for holding a plurality of articles. The carton comprises a plurality of panels that extends at least partially around an interior of the carton and comprises at least a top panel. A handle is positionable between a first position and a second position. The handle comprises at least a first handle panel and a second handle panel, and at least one of the first handle panel and the second handle panel is foldably connected to the top panel. At least one of the first handle panel and the second handle panel is generally coplanar with at least a portion of the top panel in the first position of the handle. Each of the first handle panel and the second handle panel extends upwardly relative to the top panel and the first handle panel is spaced apart from the second handle panel in the second position of the handle.

43 Claims, 9 Drawing Sheets

(51) Int. Cl.
*B65D 5/42* (2006.01)
*B65D 5/54* (2006.01)

(56) References Cited

U.S. PATENT DOCUMENTS 2,111,621 A 3/1938 Gerking et al.
2,252,023 A 8/1941 Mulnix
2,268,906 A 1/1942 Scheer
2,383,183 A 8/1945 Fischer
2,575,654 A 11/1951 Casler
2,594,376 A 4/1952 Arneson
2,661,142 A * 12/1953 Hendrickson, Jr. ..... 229/117.14
2,663,485 A 12/1953 Johnson
2,694,518 A 11/1954 Zanck et al.
2,702,144 A 2/1955 Forrer
2,737,326 A 3/1956 Toensmeier
2,764,284 A 9/1956 Arneson
2,797,856 A 7/1957 Jaeschke
2,810,506 A 10/1957 Kessler
2,868,433 A 1/1959 Anderson, Jr.
2,911,136 A 11/1959 Stone
2,950,041 A 8/1960 Stone
2,955,739 A 10/1960 Collura
2,975,934 A 3/1961 Powell
2,990,997 A 7/1961 Weiss
3,112,856 A 12/1963 MacIntosh et al.
3,127,720 A 4/1964 Gentry et al.
3,167,214 A 1/1965 Mahon
3,198,378 A 8/1965 Farquhar
3,204,815 A 9/1965 Weiss
3,245,711 A 4/1966 Dantoin
3,309,005 A 3/1967 Pilger
3,313,406 A 4/1967 Outwater
3,334,767 A 8/1967 Cornelius et al.
3,355,012 A 11/1967 Weiss
3,381,881 A 5/1968 Granz et al.
3,534,899 A * 10/1970 Hoshi et al. ..... 229/117.15
3,612,266 A 10/1971 Graser
3,722,945 A 3/1973 Wood
3,747,835 A 7/1973 Graser
3,767,041 A 10/1973 Graser
3,790,066 A 2/1974 Malinowski
3,828,926 A 8/1974 Rossi
3,860,281 A 1/1975 Wood
3,886,901 A 6/1975 Zeitler
3,904,036 A 9/1975 Forrer
3,933,303 A 1/1976 Kirby, Jr.
3,942,631 A 3/1976 Sutherland et al.
3,994,432 A 11/1976 Kirby, Jr.
4,029,204 A 6/1977 Manizza
4,032,053 A 6/1977 Wilson
4,034,852 A 7/1977 Forrer
4,036,423 A 7/1977 Gordon
4,096,985 A 6/1978 Wood
4,111,306 A 9/1978 Roccaforte
4,140,267 A * 2/1979 Scott et al. ..... 229/117.15
4,164,286 A 8/1979 Sutherland
4,171,763 A 10/1979 Card
4,180,191 A 12/1979 Wood
4,188,766 A 2/1980 Culpepper
4,192,540 A 3/1980 Oliff
4,195,765 A * 4/1980 Roccaforte et al. ..... 229/117.15
4,202,446 A 5/1980 Sutherland
4,216,861 A 8/1980 Oliff
4,244,617 A 1/1981 Manizza
4,308,995 A * 1/1982 Hanes ..... 229/117.15
4,311,268 A 1/1982 Soliven
4,318,474 A 3/1982 Hasegawa
4,318,476 A 3/1982 Wood et al.
4,326,628 A 4/1982 Wood
4,329,923 A 5/1982 Iida
4,331,289 A 5/1982 Killy
4,336,898 A 6/1982 Joyce
4,364,509 A 12/1982 Holley et al.
4,375,258 A 3/1983 Crayne et al.
4,378,905 A 4/1983 Roccaforte
4,382,505 A 5/1983 Sutherland et al.
4,386,699 A 6/1983 Sutherland
4,415,082 A 11/1983 Martin
4,424,901 A 1/1984 Lanier
4,432,579 A 2/1984 Denmark et al.
4,438,843 A 3/1984 Graser
4,440,340 A 4/1984 Bakx
4,478,334 A 10/1984 Graser
4,482,090 A 11/1984 Milliens
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,566,591 A 1/1986 Turtschan et al.
4,566,593 A 1/1986 Muller
4,582,199 A 4/1986 Schuster
4,588,084 A 5/1986 Holley, Jr.
4,653,686 A 3/1987 Wood et al.
4,681,217 A 7/1987 Hernandez
4,700,831 A 10/1987 Kassai
4,706,876 A 11/1987 Wilson
4,747,487 A 5/1988 Wood
4,784,266 A 11/1988 Chaussadas
4,784,316 A 11/1988 Crouch
4,785,991 A 11/1988 Schuster
4,802,583 A 2/1989 Calvert et al.
4,830,267 A 5/1989 Wilson
4,875,586 A 10/1989 Chaussadas
4,925,019 A 5/1990 Ganz et al.
4,941,624 A 7/1990 Schuster
4,966,324 A 10/1990 Steel
5,002,186 A 3/1991 Cooper
5,020,337 A 6/1991 Krieg
5,060,792 A 10/1991 Oliff
5,060,804 A 10/1991 Beales et al.
5,094,359 A 3/1992 DeMars et al.
5,106,014 A 4/1992 Miller
5,119,985 A 6/1992 Dawson et al.
5,135,104 A 8/1992 Jorba
5,139,147 A 8/1992 Sutherland
5,167,325 A 12/1992 Sykora
5,188,225 A 2/1993 Jorba
5,197,598 A 3/1993 Stout et al.
5,221,041 A 6/1993 Stout et al.
5,221,042 A 6/1993 Oliff
5,222,658 A 6/1993 DeMaio et al.
5,234,102 A 8/1993 Schuster et al.
5,246,112 A 9/1993 Stout et al.
5,273,156 A 12/1993 Harris
5,284,294 A 2/1994 Floyd
5,292,058 A 3/1994 Zoss et al.
5,292,059 A 3/1994 Oliff
5,297,673 A 3/1994 Sutherland
5,297,725 A 3/1994 Sutherland
5,303,863 A 4/1994 Arasim
5,307,932 A 5/1994 Stout et al.
5,307,986 A 5/1994 Schuster
5,310,050 A 5/1994 Sutherland
5,310,051 A 5/1994 Sutherland
5,320,277 A 6/1994 Stout et al.
5,323,895 A 6/1994 Sutherland et al.
5,328,024 A 7/1994 Sutherland
5,333,734 A 8/1994 Stout et al.
5,344,006 A 9/1994 Mazzeo
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,363,954 A 11/1994 Dampier
5,379,944 A 1/1995 Stout et al.
5,381,891 A 1/1995 Harris
5,385,234 A 1/1995 Stout et al.
5,390,784 A 2/1995 Sutherland
5,395,044 A 3/1995 Stout
5,407,065 A 4/1995 Sutherland
5,415,278 A 5/1995 Sutherland

(56) References Cited

U.S. PATENT DOCUMENTS

| | | | | |
|---|---|---|---|---|
| 5,427,241 | A | 6/1995 | Sutherland | |
| 5,443,153 | A | 8/1995 | Sutherland | |
| 5,445,262 | A | 8/1995 | Sutherland | |
| 5,452,799 | A | 9/1995 | Sutherland | |
| 5,458,234 | A | 10/1995 | Harris | |
| 5,472,090 | A | 12/1995 | Sutherland | |
| 5,474,172 | A | 12/1995 | Zavatone et al. | |
| 5,484,059 | A | 1/1996 | Sutherland | |
| 5,485,915 | A | 1/1996 | Harris | |
| 5,495,727 | A | 3/1996 | Strong et al. | |
| 5,501,335 | A | 3/1996 | Harris | |
| 5,503,267 | A | 4/1996 | Sutherland | |
| 5,505,304 | A | 4/1996 | Broskow et al. | |
| 5,520,283 | A | 5/1996 | Sutherland | |
| 5,524,756 | A | 6/1996 | Sutherland | |
| 5,551,556 | A | 9/1996 | Sutherland | |
| 5,582,289 | A | 12/1996 | Wright | |
| 5,582,343 | A | 12/1996 | Dalvey | |
| 5,593,027 | A | 1/1997 | Sutherland | |
| 5,598,920 | A | 2/1997 | Hansen | |
| 5,605,228 | A | 2/1997 | Baxter | |
| 5,609,251 | A | 3/1997 | Harris | |
| 5,638,956 | A | 6/1997 | Sutherland | |
| 5,639,017 | A | 6/1997 | Fogle | |
| 5,647,483 | A | 7/1997 | Harris | |
| 5,669,500 | A | 9/1997 | Sutherland | |
| 5,687,838 | A | 11/1997 | Bakx | |
| 5,699,957 | A | 12/1997 | Bin et al. | |
| 5,704,470 | A | 1/1998 | Sutherland | |
| 5,735,394 | A | 4/1998 | Harrelson | |
| 5,738,217 | A | 4/1998 | Hunter | |
| 5,738,273 | A | 4/1998 | Auclair | |
| 5,746,310 | A | 5/1998 | Slomski | |
| 5,794,778 | A | 8/1998 | Harris | |
| 5,816,391 | A | 10/1998 | Harris | |
| 5,820,185 | A | 10/1998 | Gomes | |
| 5,826,782 | A | 10/1998 | Stout | |
| 5,845,776 | A | 12/1998 | Galbierz et al. | |
| 5,871,090 | A | 2/1999 | Doucette et al. | |
| 5,873,515 | A | 2/1999 | Dunn et al. | |
| 5,878,876 | A | 3/1999 | Galbierz et al. | |
| 5,878,946 | A | 3/1999 | Frerot et al. | |
| 5,915,546 | A | 6/1999 | Harrelson | |
| 5,960,945 | A | 10/1999 | Sutherland | |
| 5,979,747 | A | 11/1999 | Gnadt et al. | |
| 5,984,086 | A | 11/1999 | Foushee et al. | |
| 5,992,733 | A | 11/1999 | Gomes | |
| D420,575 | S | 2/2000 | Rovere | |
| 6,019,276 | A | 2/2000 | Auclair | |
| 6,021,897 | A | 2/2000 | Sutherland | |
| 6,065,590 | A | 5/2000 | Spivey | |
| 6,070,790 | A * | 6/2000 | Anderson | 229/102 |
| 6,085,969 | A | 7/2000 | Burgoyne | |
| 6,105,853 | A | 8/2000 | Lamare | |
| 6,105,854 | A | 8/2000 | Spivey et al. | |
| 6,112,977 | A | 9/2000 | Sutherland et al. | |
| 6,131,803 | A | 10/2000 | Oliff et al. | |
| 6,164,526 | A | 12/2000 | Dalvey | |
| 6,170,741 | B1 | 1/2001 | Skolik et al. | |
| 6,223,891 | B1 | 5/2001 | Devens et al. | |
| 6,223,892 | B1 | 5/2001 | Bakx | |
| 6,227,367 | B1 | 5/2001 | Harrelson et al. | |
| 6,260,755 | B1 | 7/2001 | Bates et al. | |
| 6,302,320 | B1 | 10/2001 | Stout | |
| 6,315,111 | B1 | 11/2001 | Sutherland | |
| D452,154 | S | 12/2001 | Rhodes et al. | |
| 6,425,520 | B1 | 7/2002 | Peterson | |
| 6,484,903 | B2 | 11/2002 | Spivey et al. | |
| 6,488,322 | B2 | 12/2002 | Bakx | |
| 6,502,743 | B2 | 1/2003 | Ikeda | |
| 6,523,739 | B2 | 2/2003 | Heeley et al. | |
| 6,615,984 | B2 | 9/2003 | Saulas et al. | |
| 6,631,803 | B2 | 10/2003 | Rhodes et al. | |
| 6,758,337 | B2 | 7/2004 | Chargueraud et al. | |
| 6,779,655 | B2 | 8/2004 | Olsen et al. | |
| 6,834,793 | B2 | 12/2004 | Sutherland | |
| 6,848,573 | B2 | 2/2005 | Gould et al. | |
| 6,869,009 | B2 | 3/2005 | Sutherland et al. | |
| 6,896,130 | B2 | 5/2005 | Theelen | |
| 6,899,221 | B2 | 5/2005 | Skolik et al. | |
| 6,905,066 | B2 | 6/2005 | Holley et al. | |
| 6,926,193 | B2 | 8/2005 | Smalley | |
| 6,945,450 | B2 | 9/2005 | Rusnock | |
| 6,981,631 | B2 | 1/2006 | Fogle et al. | |
| 7,011,209 | B2 | 3/2006 | Sutherland et al. | |
| 7,234,596 | B2 | 6/2007 | Lebras | |
| 7,264,114 | B2 | 9/2007 | Daniel | |
| 7,296,731 | B2 | 11/2007 | Auclair et al. | |
| 7,380,701 | B2 | 6/2008 | Fogle et al. | |
| 7,416,109 | B2 | 8/2008 | Sutherland | |
| 7,427,010 | B2 | 9/2008 | Sutherland | |
| 7,472,791 | B2 | 1/2009 | Spivey, Sr. | |
| 7,601,111 | B2 | 10/2009 | Sutherland et al. | |
| 7,699,215 | B2 | 4/2010 | Spivey, Sr. | |
| 7,743,944 | B2 | 6/2010 | Ho Fung et al. | |
| 7,743,969 | B2 | 6/2010 | Bokel | |
| 7,748,603 | B2 | 7/2010 | Fogle et al. | |
| 7,757,933 | B2 | 7/2010 | Dunn | |
| 7,806,314 | B2 | 10/2010 | Sutherland | |
| 8,070,052 | B2 | 12/2011 | Spivey, Sr. et al. | |
| 8,216,118 | B2 | 7/2012 | Dunn | |
| 8,256,617 | B2 | 9/2012 | Gomes et al. | |
| 8,453,918 | B2 | 6/2013 | Hsiao et al. | |
| 8,469,184 | B2 | 6/2013 | Spivey, Sr. | |
| 8,511,463 | B2 | 8/2013 | Brand | |
| 2002/0195371 | A1 | 12/2002 | Brown | |
| 2003/0080004 | A1 | 5/2003 | Olsen et al. | |
| 2003/0111362 | A1 | 6/2003 | Sutherland et al. | |
| 2003/0213263 | A1 | 11/2003 | Woog | |
| 2003/0213705 | A1 | 11/2003 | Woog | |
| 2004/0074954 | A1 | 4/2004 | Fogle et al. | |
| 2004/0079666 | A1 | 4/2004 | Bakx | |
| 2004/0226833 | A1 | 11/2004 | Daniel | |
| 2005/0056658 | A1 | 3/2005 | Spivey | |
| 2005/0167478 | A1 | 8/2005 | Holley, Jr. | |
| 2006/0071058 | A1 | 4/2006 | Spivey, Sr. | |
| 2006/0169755 | A1 | 8/2006 | Spivey, Sr. | |
| 2006/0266812 | A1 * | 11/2006 | Von Bokel | 229/117.14 |
| 2006/0273143 | A1 | 12/2006 | Finch | |
| 2007/0029371 | A1 | 2/2007 | Theelen | |
| 2007/0039846 | A1 | 2/2007 | Spivey, Sr. | |
| 2007/0051781 | A1 | 3/2007 | Holley, Jr. | |
| 2007/0108261 | A1 | 5/2007 | Schuster | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0083820 | A1 | 4/2008 | Walling et al. | |
| 2008/0119344 | A1 | 5/2008 | Sutherland et al. | |
| 2009/0236408 | A1 | 9/2009 | Spivey, Sr. | |
| 2009/0255983 | A1 | 10/2009 | De Paula et al. | |
| 2010/0089987 | A1 * | 4/2010 | Brandinelli | 229/117.22 |
| 2010/0213249 | A1 | 8/2010 | Requena | |
| 2010/0270367 | A1 | 10/2010 | Brandenburger | |
| 2010/0320098 | A1 | 12/2010 | Brand | |
| 2011/0048975 | A1 | 3/2011 | Brand | |
| 2012/0104079 | A1 | 5/2012 | Wagner | |

FOREIGN PATENT DOCUMENTS

| | | | | |
|---|---|---|---|---|
| DE | 85 14 718.4 | | 6/1985 | |
| DE | 9308141.3 | U1 * | 9/1993 | B65D 5/46088 |
| DE | 296 07 374 | | 4/1996 | |
| DE | 196 42 571 | A1 | 5/1997 | |
| DE | 201 12 228 | | 11/2002 | |
| DE | 203 17 334 | U1 | 2/2004 | |
| DE | 20 2004 004 248 | U1 | 8/2004 | |
| DE | 20 2004 017 954 | U1 | 2/2005 | |
| DE | 20 2004 018 649 | | 4/2005 | |
| EP | 0 048 506 | | 3/1982 | |
| EP | 0 285 043 | A1 | 10/1988 | |
| EP | 0 398 835 | B1 | 11/1990 | |
| EP | 0 412 226 | | 2/1991 | |

(56) References Cited

FOREIGN PATENT DOCUMENTS

| | | | | | |
|---|---|---|---|---|---|
| EP | 0 473 266 | | | 3/1992 | |
| EP | 0 495 197 | A1 | | 7/1992 | |
| EP | 0 541 334 | A1 | | 5/1993 | |
| EP | 0 780 320 | A1 | | 6/1997 | |
| EP | 1 070 671 | A1 | | 1/2001 | |
| EP | 1 384 679 | A1 | | 1/2004 | |
| EP | 1 612 157 | | | 1/2006 | |
| FR | 1274610 | A | * | 9/1961 | ..... B65D 5/46152 |
| FR | 1 494 239 | | | 9/1967 | |
| FR | 1 582 235 | | | 9/1969 | |
| FR | 2 525 992 | | | 11/1983 | |
| FR | 2 579 175 | | | 9/1986 | |
| FR | 2634456 | A1 | * | 1/1990 | ..... 229/117.14 |
| FR | 2 664 239 | | | 1/1992 | |
| FR | 2 731 413 | | | 9/1996 | |
| GB | 1 342 180 | | | 12/1973 | |
| GB | 2 085 391 | A | | 4/1982 | |
| GB | 2 158 037 | A | | 11/1985 | |
| JP | 05-147643 | A | | 6/1993 | |
| JP | 8-507486 | | | 8/1996 | |
| JP | 2003-146359 | | | 5/2003 | |
| JP | 2003-300554 | | | 10/2003 | |
| JP | 38-17186 | | | 8/2006 | |
| KR | 20-0356729 | | | 7/2004 | |
| WO | WO 95/02546 | | | 1/1995 | |
| WO | WO 96/27538 | | | 9/1996 | |
| WO | WO 97/33807 | | | 9/1997 | |
| WO | WO 98/49071 | | | 11/1998 | |
| WO | WO 99/01356 | | | 1/1999 | |
| WO | WO 99/28207 | | | 6/1999 | |
| WO | WO 00/78618 | | | 12/2000 | |
| WO | WO 01/66434 | | | 9/2001 | |
| WO | WO 02/059011 | A2 | | 8/2002 | |
| WO | WO 02/062676 | A1 | | 8/2002 | |
| WO | WO 02/079048 | A1 | | 10/2002 | |
| WO | WO 03/016167 | A1 | | 2/2003 | |
| WO | WO 03/037742 | | | 5/2003 | |
| WO | WO 2005/080218 | | | 9/2005 | |
| WO | WO 2005/095222 | A1 | | 10/2005 | |
| WO | WO 2005/123532 | | | 12/2005 | |
| WO | WO 2006/044583 | A2 | | 4/2006 | |
| WO | WO 2006/108098 | A1 | | 10/2006 | |
| WO | WO 2007/044525 | A1 | | 4/2007 | |
| WO | WO 2007/089282 | | | 8/2007 | |
| WO | WO 2009-117562 | A1 | | 9/2009 | |

OTHER PUBLICATIONS

International Search Report and Written Opinion for PCT/US2013/027913 dated Jul. 1, 2013.

* cited by examiner

CARTON WITH HANDLE

CROSS-REFERENCE TO RELATED APPLICATION

This application claims the benefit of U.S. Provisional Patent Application Ser. No. 61/850,238, filed Feb. 11, 2013.

INCORPORATION BY REFERENCE

The disclosure of U.S. Provisional Patent Application No. 61/850,238, which was filed Feb. 11, 2013, is hereby incorporated by reference as if presented herein in its entirety.

BACKGROUND OF THE DISCLOSURE

The present disclosure generally relates to cartons or carriers for holding beverage containers or other types of articles. More specifically, the present disclosure relates to cartons that include handle features.

SUMMARY OF THE DISCLOSURE

In general, one aspect of the disclosure is directed to a carton for carrying a plurality of articles. The carton comprises at least one top panel, a first side panel, a second side panel, and a bottom panel. The at least one top panel has a handle for grasping and carrying the carton. The handle has reinforcement features and contact features.

In general, one aspect of the disclosure is directed to a carton for holding a plurality of articles. The carton comprises a plurality of panels that extends at least partially around an interior of the carton. The plurality of panels comprises at least a top panel. A handle is positionable between a first position and a second position. The handle comprises at least a first handle panel and a second handle panel, and at least one of the first handle panel and the second handle panel is foldably connected to the top panel. At least one of the first handle panel and the second handle panel is generally coplanar with at least a portion of the top panel in the first position of the handle, and each of the first handle panel and the second handle panel extends upwardly relative to the top panel and the first handle panel is spaced apart from the second handle panel in the second position of the handle.

In another aspect, the present disclosure is generally directed to a blank for forming a carton. The blank comprises a plurality of panels comprising at least a top panel. The blank further comprises handle features for forming a handle that is positionable between a first position and a second position in the carton formed from the blank. The handle features comprise at least a first handle panel and a second handle panel, and at least one of the first handle panel and the second handle panel is foldably connected to the top panel. At least one of the first handle panel and the second handle panel is for being generally coplanar with at least a portion of the top panel in the first position of the handle in the carton formed from the blank. Each of the first handle panel and the second handle panel is for extending upwardly relative to the top panel and the first handle panel is for being spaced apart from the second handle panel in the second position of the handle in the carton formed from the blank.

In another aspect, the present disclosure is generally directed to a method of forming a carton. The method comprises obtaining a blank comprising a plurality of panels comprising at least a top panel, and handle features comprising at least a first handle panel and a second handle panel. At least one of the first handle panel and the second handle panel is foldably connected to the top panel. The method further comprises forming an interior of the carton at least partially defined by the plurality of panels and forming a handle from the handle features. The handle is positionable between a first position and a second position. At least one of the first handle panel and the second handle panel is generally coplanar with at least a portion of the top panel in the first position of the handle. Each of the first handle panel and the second handle panel extends upwardly relative to the top panel and the first handle panel is spaced apart from the second handle panel in the second position of the handle.

Other aspects, features, and details of the present disclosure can be more completely understood by reference to the following detailed description of exemplary embodiments taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
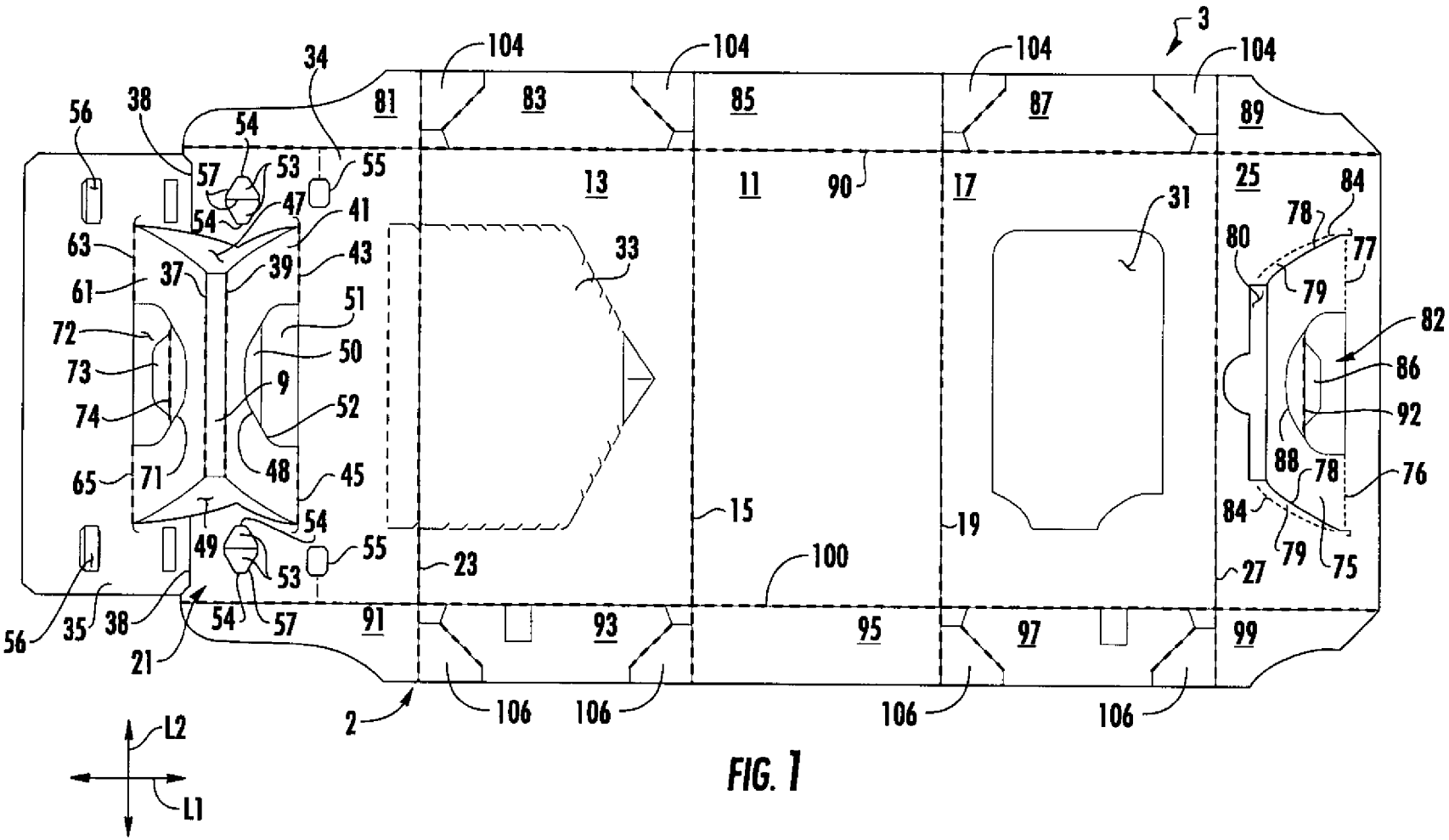
FIG. 1 is a plan view of a blank used to form a carton according to a first exemplary embodiment of the disclosure.
Figure 3:
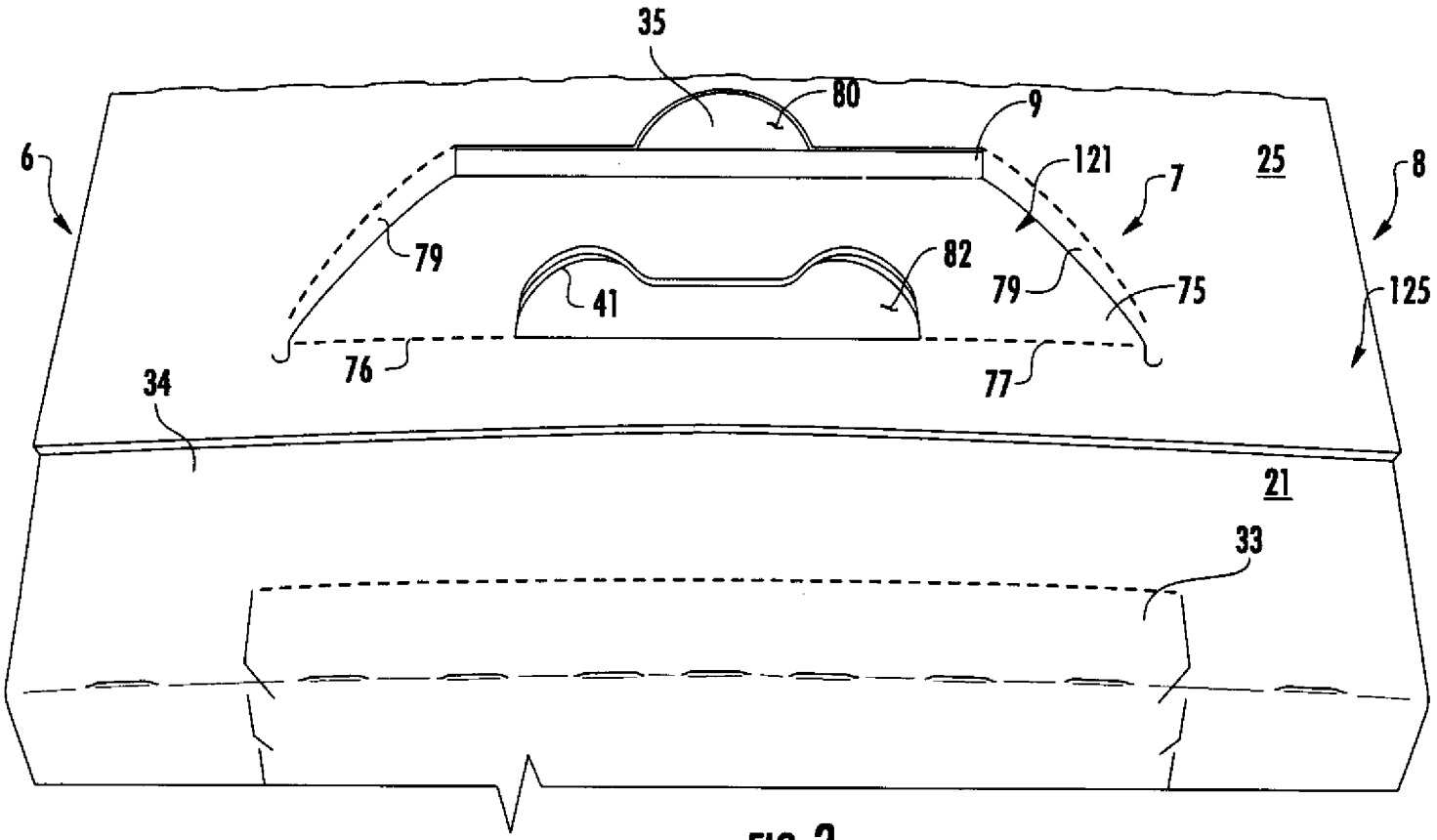
FIG. 3 is a perspective view of the erected carton according to the first exemplary embodiment of the disclosure.
Figure 4:
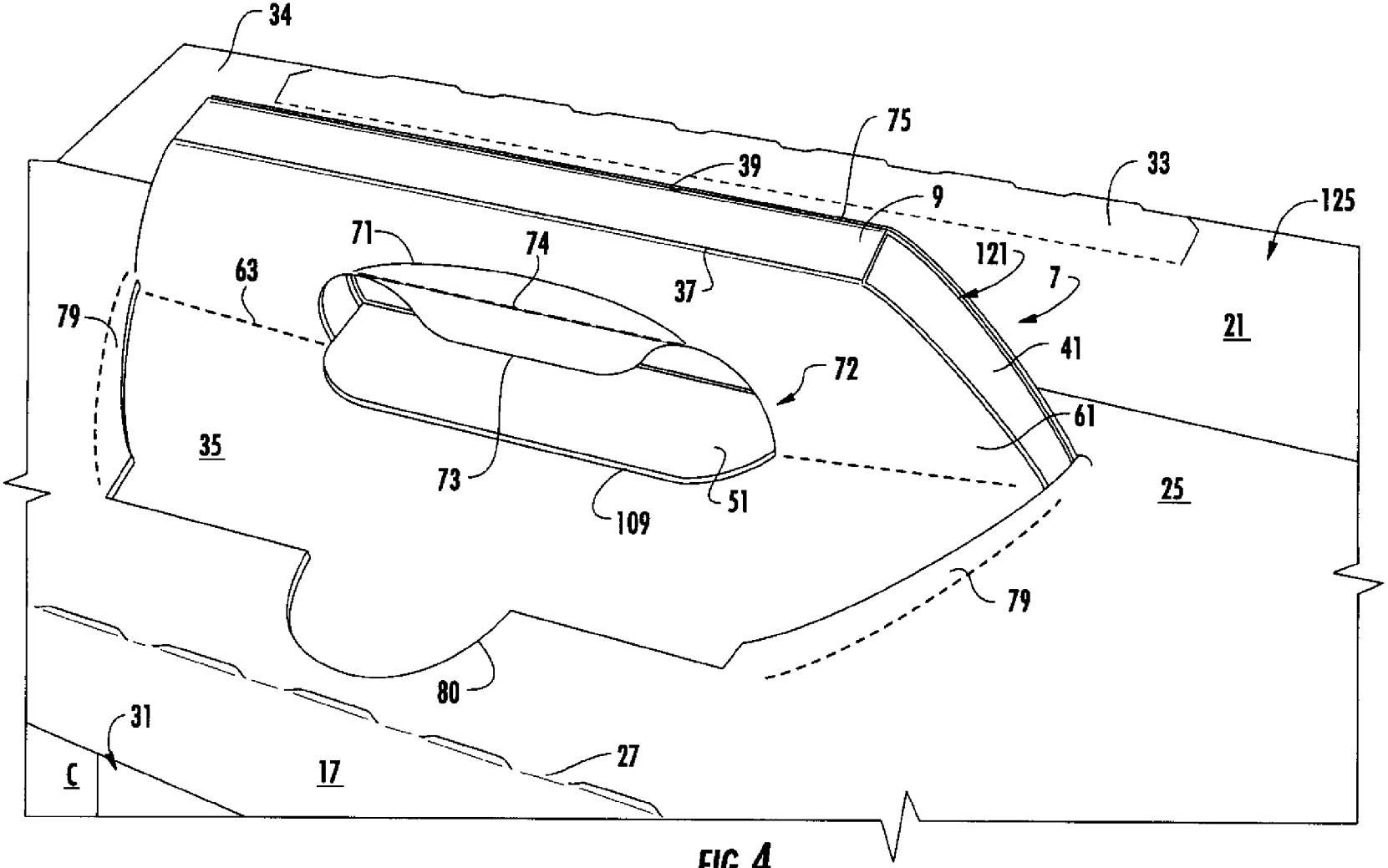
FIGS. 4 and 5 are perspective views showing the actuation of a handle of the carton of FIG. 3.
Figure 5:
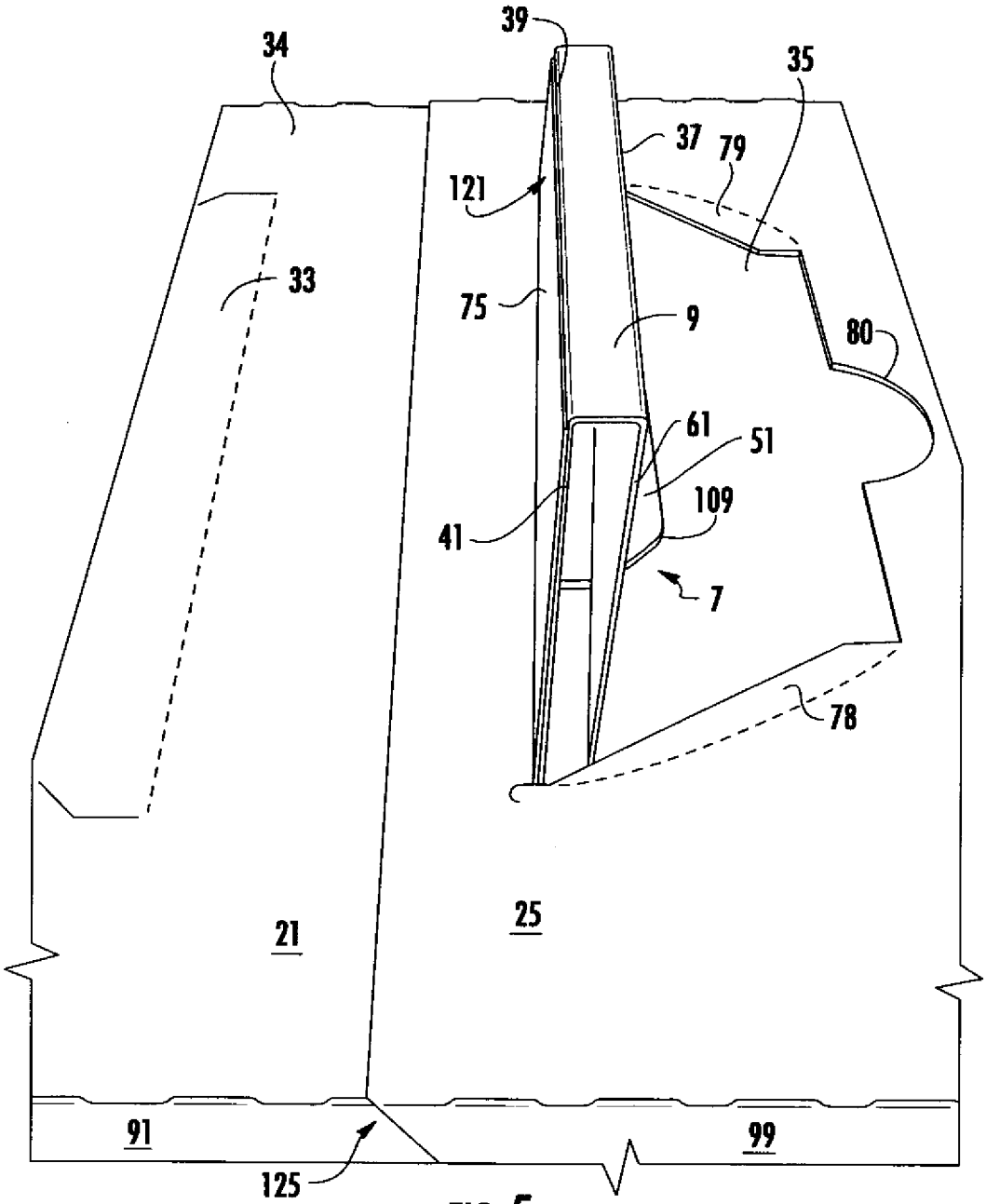

FIG. 1 is a plan view of an exterior surface 2 of a blank 3, used to form a carton 5, shown in FIGS. 3-5, according to one embodiment of the disclosure. The carton 5 can be used to house a plurality of articles such as containers C (e.g., see exemplary containers C shown in FIGS. 8 and 9 of the second embodiment). In one embodiment, the containers C can be brick-shaped containers commonly referred to as TETRA PAK© containers that contain a liquid beverage or other food or beverage product. The containers C can be any suitable container such as any shape, size, and type of container that is commercially available from Tetra Pak International SA, Lausanne, Switzerland, such as TETRA BRIK packages, TETRA BRIK ASEPTIC packages, TETRA PRISM ASEPTIC packages, or any other suitable package or container (see www.tetrapak.com for more information). The containers C could be other suitable containers made from other materials by other manufactures (e.g., PET bottles, yogurt containers, juice-boxes, beverage cans, etc.) without departing from the disclosure.

In one embodiment, the blank 3 is sized to form a carton 5 that contains twelve containers C or packages in a single layer in a 3×4 arrangement. But, it is understood that the blank 3 and/or carton 5 may be sized and shaped to hold containers C of a different or same quantity in more than one layer and/or in different row/column arrangements (e.g., 1×6, 2×3, 2×6, 2×4, 2×2, 2×6×2, 2×4×2, 2×9, etc.). In the illustrated embodiment, the carton 5 has at least partially open ends 6, 8 and generally wraps around the containers C contacting the top and bottom of the group of containers. In one embodiment, the carton 5 may be referred to as a "wrap-around carton or carrier." Alternatively, the carton 5 could be a carton with ends that are at least partially closed by one or more end flaps with the containers being loaded into the partially formed carton prior to closing one or more ends of the carton without departing from the disclosure.

The carton 5 has a reinforced handle 7 (FIGS. 3-5) that is used for grasping and carrying the carton. The handle 7 is formed by multiple layers of material of the blank 3 so that the handle is strengthened to reduce handle failure and has a thickness to enhance comfort in carrying the carton. According to one embodiment of the invention, the handle 7 is formed of at least three layers of material, with one portion of the handle comprising a dual-layer (e.g., formed from a first handle panel 41 and a third handle panel 75) and another portion of the handle comprising a single layer (e.g., formed from a second handle panel 61). According to another embodiment of the invention, the handle 7 is formed of at least two layers of material, with one portion of the handle comprising a single layer and another portion of the handle comprising a single layer. The thickness of the handle 7 is produced by an intermediate handle panel 9 and an associated spacing between the handle portions noted above. The intermediate handle panel 9 may have any desired width. According to at least one embodiment of the invention, the handle panel 9 comprises a width comparable to about two layers of corrugated cardboard stock. In this manner, the handle 7 may produce a unique and sturdy "feel" that is comparable to a corrugated cardboard handle while actually being formed of relatively thinner paperboard material. The handle 7 could be otherwise shaped, arranged, and/or configured or could be omitted without departing from the disclosure.

As shown in FIG. 1, the blank 3 has a longitudinal axis L1 and a lateral axis L2. In the illustrated embodiment, the blank 3 comprises a bottom panel 11 foldably connected to a first side panel 13 at a lateral fold line 15, a second side panel 17 foldably connected to the bottom panel at a lateral fold line 19, a first top panel 21 foldably connected to the first side panel 13 at a lateral fold line 23, and a second top panel 25 foldably connected to the second side panel 17 at a lateral fold line 27. In one embodiment, the second side panel 17 includes an opening or window 31. In one embodiment, the first top panel 21 and the first side panel 13 include a dispenser 33.

In the illustrated embodiment, the first top panel 21 includes a main portion 34 foldably connected to the first side panel 13 at the fold line 23 and a distal portion 35 foldably connected to the main portion 34 by the first and second handle panels 41, 61 and the intermediate panel 9. The distal portion 35 is also partially separated from the main portion 34 through lateral cuts 38. The first handle panel 41 is foldably connected to the main portion 34 at lateral fold lines 43, 45 and is at least partially defined by cut outs 47, 49 in the top panel 21. As shown in FIG. 1, the first handle panel 41 can include a handle flap 50 that is foldably connected to the first handle panel along a curved fold line 48. An elongate projection 51 is adjacent the first handle panel 41 in the main portion 34 of the first top panel 21 and is at least partially defined by arcuate cut 52. The main portion 34 of the first top panel 21 includes two pairs of locking tabs 53 that are generally aligned in the longitudinal direction L1 and are spaced apart in the longitudinal direction L1, and a plurality of glue openings 55 that are generally aligned in the longitudinal direction L1 and are spaced apart in the longitudinal direction L1. As shown in FIG. 1, the locking tabs 53 are foldably connected to the main portion 34 along respective longitudinal fold lines 54 and are separable from the main portion 34 along cuts 57 formed therein. The distal portion 35 of the first top panel 21 has a plurality of locking openings 56 that are generally aligned in the longitudinal direction L1 and are spaced apart in the longitudinal direction L1. As will be discussed later below, the locking tabs 53, the locking openings 55, and the glue openings 56 can cooperate to help secure the main portion 34 of the first top panel 21 to the distal portion 35 of the top panel.

In the first embodiment, the second handle panel 61 foldably connected to the distal portion 35 of the top panel 21 along lateral fold lines 63, 65 and to the intermediate handle panel 9 at fold line 37. The intermediate handle panel 9 is foldably connected to the first handle panel 41 at fold line 39. In the illustrated embodiment, the second handle panel 61 is at least partially defined by the cutouts 47, 49. Also, a comfort flap 73 is foldably connected to the second handle panel 61 along a curved fold line 71 and includes a lateral fold line 74. The second handle panel 61 and the comfort flap 73 can be at least partially defined by an opening 72 in the distal portion 35.

As shown in FIG. 1, the third handle panel 75 is foldably connected to the second top panel 25 at two lateral fold lines 76, 77. The third handle panel 75 is at least partially defined by cuts 78 and an opening 80. The cuts 78 and the opening 80 can at least partially form respective flaps 79 in the second top panel 25. The flaps 79 can be further defined by arcuate fold lines 84 and can help retain the handle 7 in the closed position (FIG. 3) by at least partially overlapping at least the second handle panel 61 when the handle is in the flattened position. When the handle 7 is actuated, the second handle panel 61 can push the flaps 79 upwardly out of the way as the second handle panel is folded upwardly. As shown in FIG. 1, a handle flap 86 can be foldably connected to the third handle panel 75 along a curved fold line 88 and can include a lateral fold line 74. The third handle panel 75 and the handle flap 86 can be at least partially defined by an opening 82 in the second top panel 25. The first handle panel 41, the second handle panel 61, the third handle panel 75, and the intermediate handle panel 9 combine to form the handle 7 in a manner that will be described in further detail below. One or more of the handle panels 9, 41, 61, 75 could be otherwise shaped, arranged, configured, and/or omitted without departing from the disclosure.

In one embodiment, the panels 11, 13, 17, 21, 25 have respective first end flaps 81, 83, 85, 87, 89 at a first marginal portion of the blank 3 such that the first end flaps are foldably connected to respective panels by a longitudinal fold line 90. The panels 11, 13, 17, 21, 25 have respective second end flaps 91, 93, 95, 97, 99 at a second marginal portion of the blank 3 such that the second end flaps are foldably connected to respective panels by a longitudinal fold line 100. The first end flaps 81, 83, 85, 87, 89 are for at least partially closing the first end 6 of the carton 5 and the second end flaps 91, 93, 95, 97, 99 are for at least partially closing the second end 8 of the carton. One or more of the first end flaps 81, 83, 85, 87, 89 and second end flaps 91, 93, 95, 97, 99 can be foldably connected to each other at respective fold lines, or one or more of the end flaps can have respective gussets or webs foldably connecting adjacent first or second end flaps or one or more of the end flaps can be tuck-in panels or flaps without departing from the disclosure. In the illustrated embodiments, the end flaps 83, 93, 87, 97 are tuck-in flaps that are folded into face-to-face contact with the respected side panels 13, 17 and are disposed between a container C adjacent the respective side panel 13, 17 and the respective side panel. The tuck-in flaps 83, 87 are connected to the bottom end flap 85 and to the respective top end flaps 81, 89 by respective gussets 104 so that the end flaps 81, 89 can extend over the partially closed end 6 when the tuck-in flaps 83, 87 are in face-to-face contact with the side panels 13, 17. Similarly, the tuck-in flaps 93, 97 are connected to the bottom end flap 95 and to the respective top end flaps 91, 99 by respective gussets 106 so that the end flaps 91, 99 can extend over the partially closed end 8 when the tuck-in flaps 93, 97 are in face-to-face contact with the side panels 13, 17. The end flaps could be otherwise shaped, arranged, configured, and/or omitted without departing from the disclosure.

Figure 2:
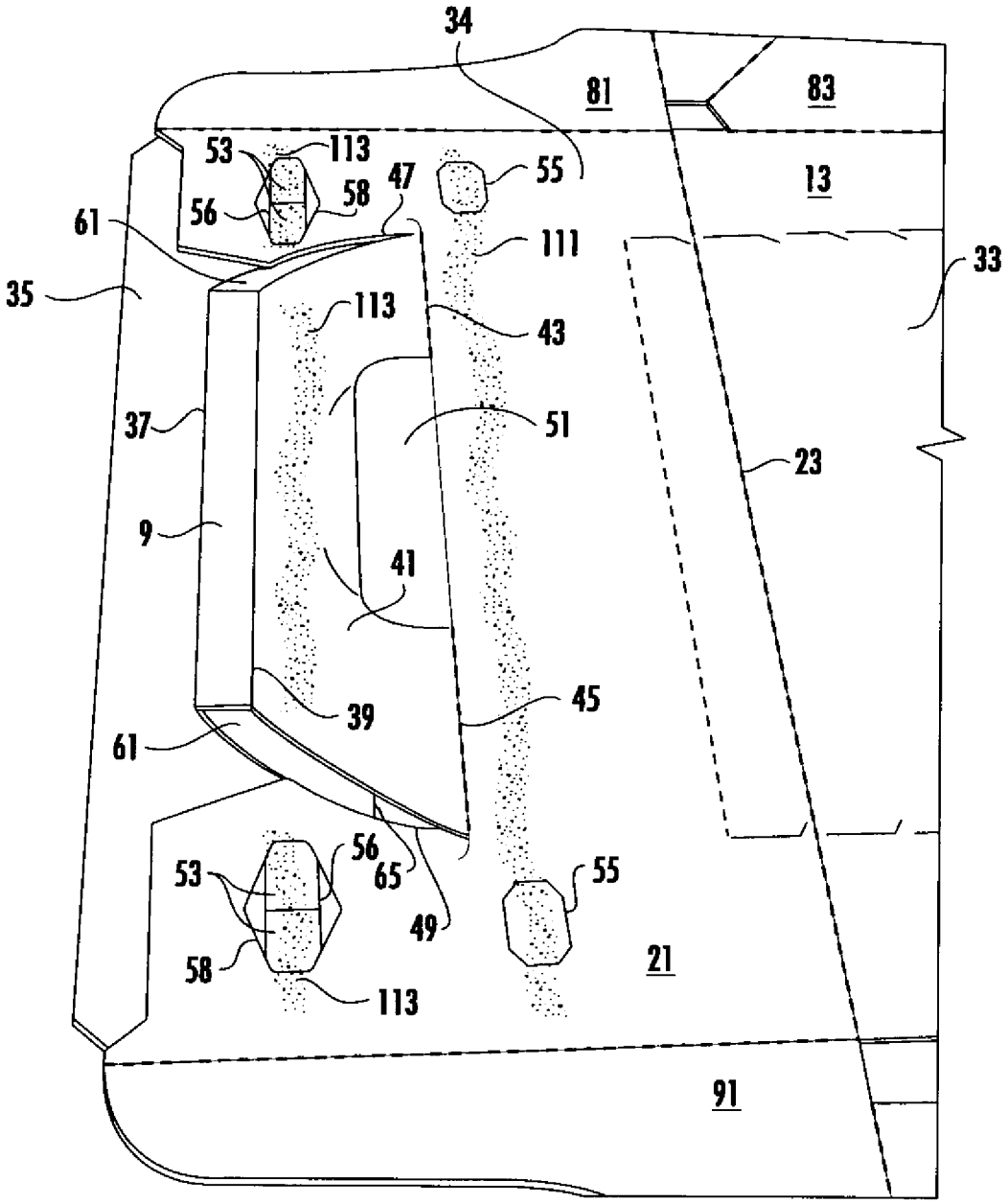
FIG. 2 is a perspective view of a partially-erected carton according to the first exemplary embodiment of the disclosure.

FIGS. 2 and 3 show one exemplary method of forming the blank 3 into the carton 5. In one embodiment, the blank is first placed with an interior surface facing up and containers C are placed on the bottom panel 11. Prior to or after placing the containers C on the bottom panel 11, the distal portion 35 of the first top panel 21 can be positioned relative to the main portion 34 as shown in FIG. 2 to begin forming the thickened handle 7. The distal portion 35 is positioned such that the second handle panel 61 is folded generally underneath the first handle panel 41 and the intermediate portion 9 about the fold line 37 with the interior surface of the second handle panel 61 being at least partially in face-to-face registration with the interior portion of the first handle panel 41 and the intermediate handle panel 9 (FIG. 2). The distal portion 35 is folded with respect to the second handle panel 61 along the fold lines 63, 65 so that the exterior surface of the distal portion 35 is at least partially in face-to-face contact with the exterior surface of the second handle panel 61 and an interior surface of the main portion 34 of the first top panel 21. The locking tabs 53 in the main portion 34 can be folded downwardly along fold lines 57 through the respective locking openings 56 so that the wider portions of the locking tabs 53 engage underneath the distal portion 35. The locking tabs 53 can form respective openings 58 in the main portion 34 when folded down along fold lines 57. When the main portion 34 and distal portion 35 of the first top panel 21 are positioned as shown in FIG. 2, glue 111, 113 (e.g., glue strips) or other adhesive can be applied as indicated. The glue 111 can be applied in a laterally extending line across openings 55. The glue 113 can be applied in a laterally extending line across openings 58, the first handle panel 41 and the exterior surface of the main portion 34. The glue 111, 113 applied across the openings 58, 55 can also be applied to the portions of the locking tabs 53 and the distal portion 35 that are located below the openings 58, 55. The locking features and/or the glue 111, 113 could be otherwise shaped, arranged, configured, and/or omitted without departing from the disclosure.

In one embodiment, a leading edge portion 109 of the main portion 34, or other features of the handle 7, can have engaging or locking features that engage one or more features or portions of the distal portion 35 or other feature to allow the handle 7 to be formed without the need for glue or tape. In one embodiment, the folding of the distal portion 35 relative to the main portion 33 of the first top panel 21 from the position of FIG. 1 to the position of FIG. 2 can be a "Z-fold" with the handle panel 61 being folded relative to the handle panel 41 at fold line 37 and the distal portion 35 being moved or slid in the longitudinal direction L1 so that the exterior surface of the distal portion generally fits below the interior surface of the main portion as the handle panel 61 folds under the handle panel 41. Further, the handle 7 could be formed by other features or the features shown and described herein could be otherwise shaped, arranged, configured, and/or omitted without departing from the disclosure.

Turning back to FIG. 1, the blank 3 may be formed around a container or containers such that the first top panel 21, with the main portion 34 and the distal portion 35, positioned as described above, contacts the tops of the containers. The second side panel 17 can be folded up against the containers and the second top panel 25 positioned to overlap the first top panel 21. The third handle panel 75 overlaps the first handle panel 41 and is adhered to the first handle panel by the glue 113 applied to the first handle panel 41 (FIG. 3). The second top panel 25 is secured to the main portion 34 of the top panel 21 and to the folded under distal portion 35 of the top panel 21 through the openings 58, 55 in the main portion 34 by the glue 111, 113.

The handle 7 of the carton 5 includes a reinforced handle portion 121 that is formed by the two handle panels 41, 75 that are overlapped and adhered in the manner described above or an alternative method of forming. The handle 7 is shown in a first position in FIG. 3 and can be actuated to a second position shown in FIGS. 4 and 5. For example, the handle 7 can be grasped at the opening 80 (e.g., grasping the second handle panel 61) and lifted, folding the second handle panel 61, the intermediate handle panel 9, and the handle portion 121 along fold lines 37, 39, 41, 45, 63, 65, 76, 77. As the handle 7 is folded upwardly (FIGS. 4 and 5), the first handle panel 41 can separate from the projection 51 along the cut line 52, forming the leading edge 109, the intermediate portion 9 can pass through the opening 80 in the second top panel 25, and the handle panel 61 and the handle portion 121 can push past the flaps 79 in the second top panel 25. Accordingly, the handle 7 pushes the flaps 79 upwardly along the curved fold lines 84 as the handle panel 61 and the handle portion 121 are pivoted upwardly. As shown in FIG. 3, the carton 5 includes a reinforced top wall 125 that is formed by the overlapping and adhering of the three layers of material (e.g., the second top panel 25 and the distal portion 35 and the main portion 34 of the first top panel 21).

In one embodiment, the handle 7 includes the reinforced handle portion 121 and the second handle panel 61 that can extend upwards from the top wall 125 when the handle is activated in the second position (FIGS. 4 and 5). Further, the handle 7 includes the intermediate handle panel 9 that is foldably connected to the reinforced handle portion 121 and the second handle panel 61. In one embodiment, the intermediate handle panel 9 maintains the spaced-apart distance between the reinforced handle portion 121 and the second handle panel 61 so the handle 7 has a thickness when grasped by the user. The intermediate handle panel 9 can be generally orthogonal relative to the reinforced handle portion 121 and the second handle panel 61, or the intermediate handle panel 9 could be otherwise shaped, arranged, and/or positioned (e.g., angled) without departing from the scope of the disclosure.

Figure 6:
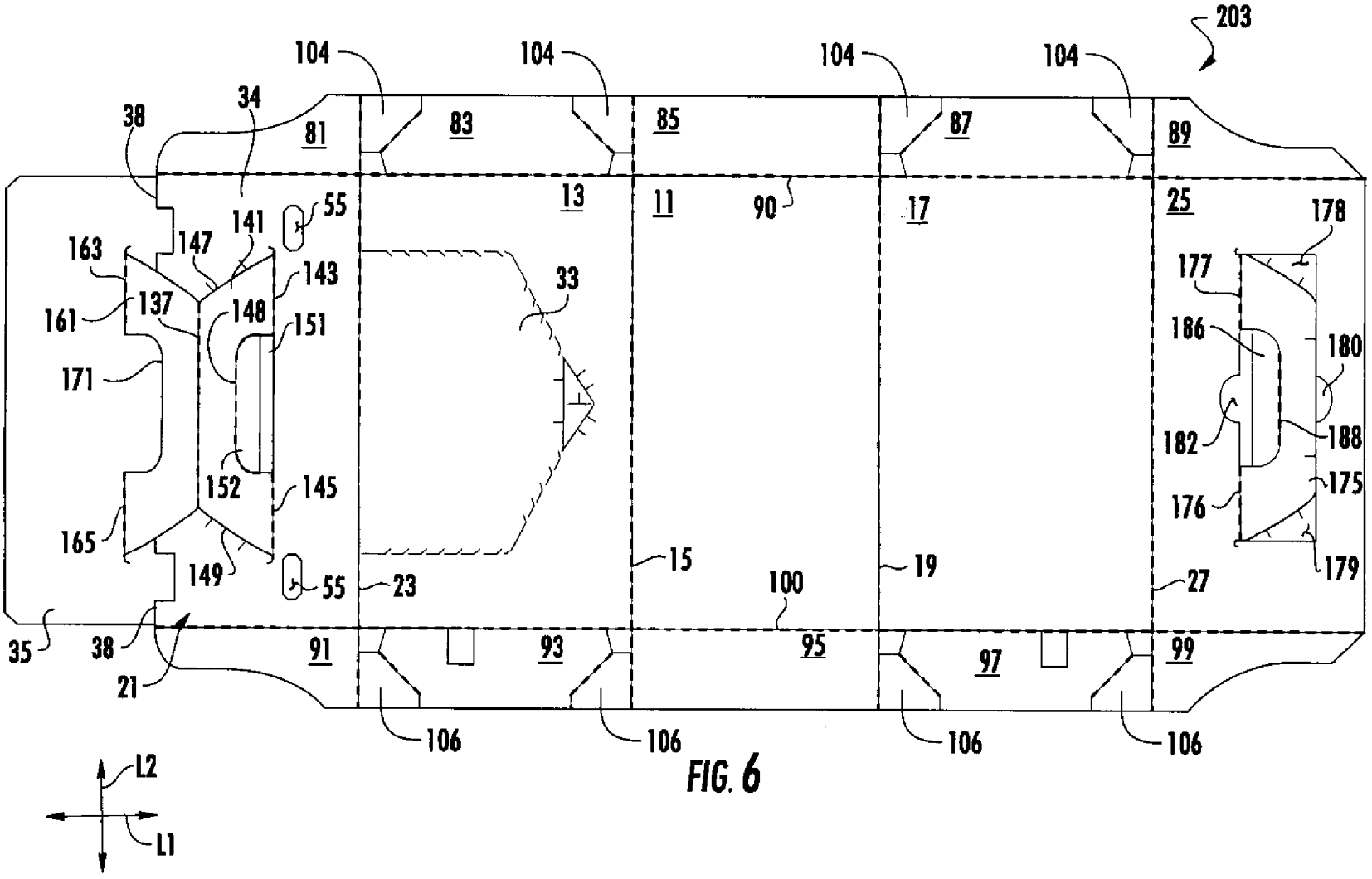
FIG. 6 is a plan view of a blank used to form a carton according to a second exemplary embodiment of the disclosure.

FIG. 6 shows a blank 203 of a second embodiment of the disclosure having similar features as the first embodiment. Accordingly, similar or identical features of the embodiments are provided with identical or similar reference numbers.

Figure 8:
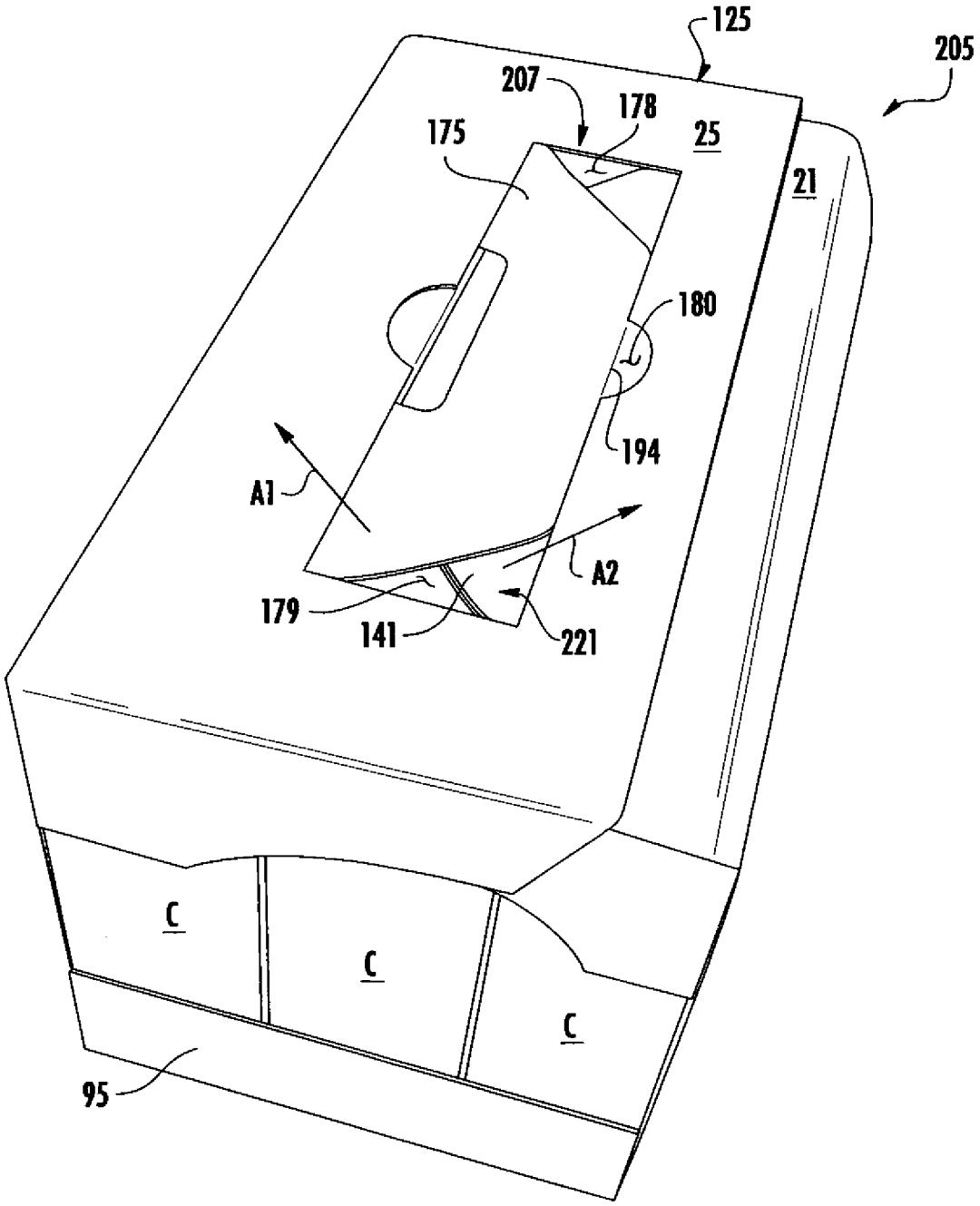
FIG. 8 is a perspective view of the erected carton according to the second exemplary embodiment of the disclosure.
Figure 9:
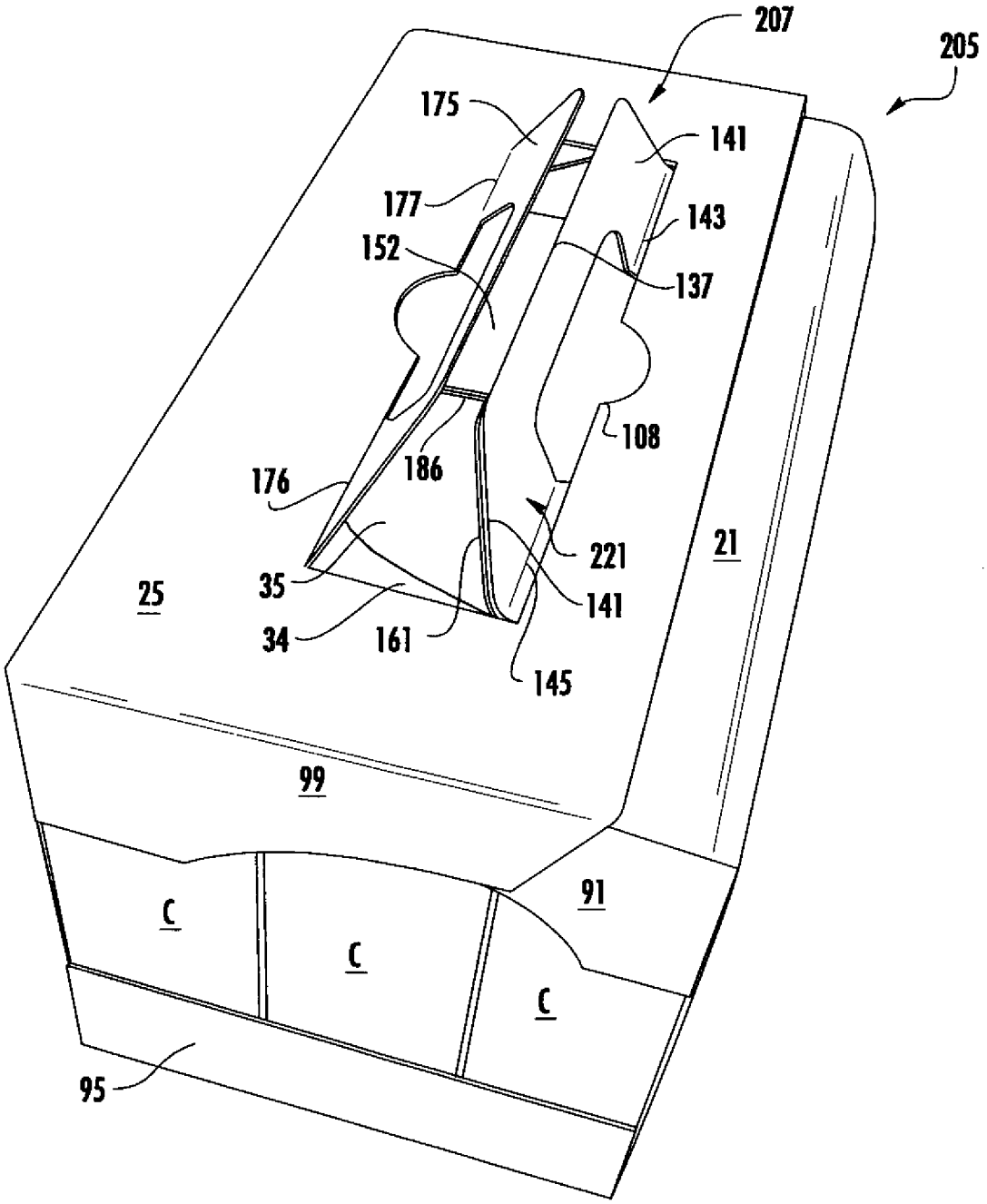
FIG. 9 is a perspective view of the carton of FIG. 3 showing the actuation of a handle.

The blank 203 may be used to form a carton 205 (FIGS. 8 and 9). The carton 205 has a reinforced handle 207 that is used for grasping and carrying the carton. The handle 207 is formed by multiple layers of material of the blank 203 so that the handle is strengthened to reduce handle failure, and thickened in a triangular formation to enhance comfort in carrying the carton. According to one embodiment of the invention, the handle 207 is formed of at least three layers of material, with one portion of the handle comprising a dual-layer (e.g., a first handle panel 141 and a second handle panel 161) and another portion of the handle comprising a single layer (e.g., a third handle panel 175). According to another embodiment of the invention, the handle 207 is formed of at least two layers of material, with one portion of the handle comprising a single layer and another portion of the handle comprising a single layer. The thickness of the handle 207 is produced by a triangular arrangement facilitated by an associated spacing between the handle portions. In this manner, the handle 207 may produce a unique and sturdy "feel" which is comparable to a corrugated cardboard handle while actually being formed of relatively thinner paperboard material.

As shown in FIG. 6, the blank 203 has a longitudinal axis L1 and a lateral axis L2. In the illustrated embodiment, the first top panel 21 includes a main portion 34 foldably connected to the first side panel 13 at the fold line 23 and a distal portion 35 foldably connected to the main portion 34 by at least the first handle panel 141 and the second handle panel 161. The first handle panel 141 is foldably connected to the main portion 34 at lateral fold lines 143, 145 and at least partially defined by tear or cut lines 147, 149 in the top panel 21. An elongate handle flap 152 is foldably connected to the first handle panel 141 along a lateral fold line 148 adjacent an opening in the main portion 34 of the first top panel 21.

In the illustrated embodiment, the second handle panel 161 is foldably connected to the first handle panel 141, through the fold line 137. The second handle panel 161 is foldably connected to the distal portion 35 at lateral fold lines 163, 165 and is at least partially defined by the cut lines 147, 149. Also, the second handle panel 161 is defined by a curved cut 171.

As also shown in FIG. 6, the third handle panel 175 is foldably connected to the second top panel 25 at two lateral fold lines 176, 177. The third handle panel 175 is at least partially defined by cutouts 178, 179 and an opening 180 adjacent to the third handle panel 175. In the illustrated embodiment, the third handle panel 175 can include an elongate handle flap foldably connected to the third handle panel along lateral fold line 188 adjacent an opening 182 in the second top panel 25. The first handle panel 141, the second handle panel 161, and the third handle panel 175 combine to form the handle 207 in a manner that will be described in further detail below. One or more of the handle panels 141, 161, 175 could be otherwise shaped, arranged, and/or omitted without departing form the disclosure.

Figure 7:
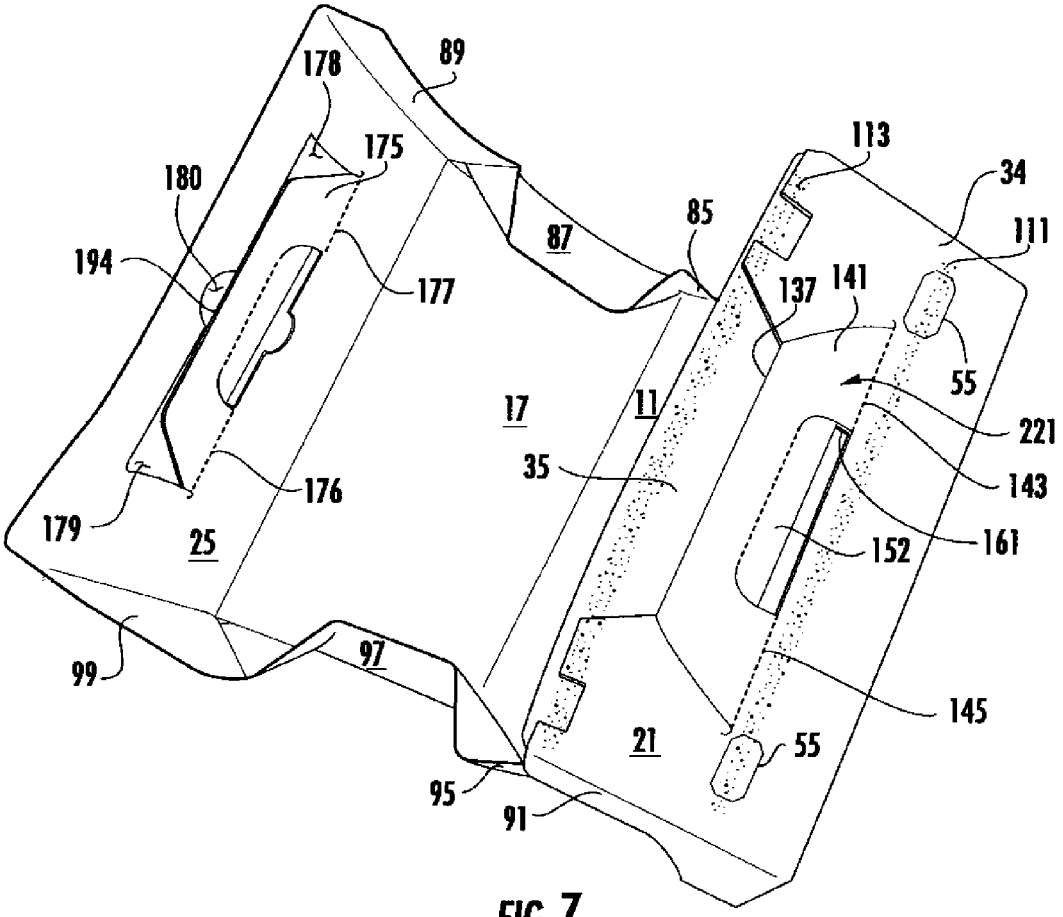
FIG. 7 is a perspective view of a partially-erected carton according to the second exemplary embodiment of the disclosure.

In the illustrated embodiment, the carton 205 can be erected from the blank 203 (FIGS. 7 and 8) in a similar manner as the carton 5 is erected in the first embodiment. However, the distal portion 35 of the first top panel 21 and the second handle panel 161 are "Z-folded" under the main portion 34 of the first top panel 21 by folding the second handle panel 161 along the lateral fold line 137 so that the interior surface of the second handle panel 161 is at least partially in face-to-face contact with the interior surface of the first handle panel 141 to form the reinforced handle portion 221. In one embodiment, the first and second handle panels 141, 161 are generally the same size and the first handle panel overlaps substantially all of the second handle panel when the handle 207 is formed. Additionally, the first handle panel 141 and the second handle panel 161 can be glued together to form the handle portion 221 in one embodiment. Alternatively, the handle panels could be differently shaped and/or otherwise configured. The distal portion 34 is folded relative to the second handle panel 161 along the lateral fold lines 163, 165 so that the exterior surface of the distal portion 35 is at least partially in face-to-face contact with the exterior surface of the second handle panel 161 and the interior surface of the main portion 34.

The containers C can be placed on the bottom panel 11, and the side panels 13, 17 can be folded upwardly while folding the tuck-in flaps 83, 93, 87, 97 against the respective side panels 13, 17. The side panels 13, 17 and the tuck-in flaps 83, 93, 87, 97 can be folded against the containers C, and the top and bottom end flaps 81, 85, 89, 91, 95, 99 can be folded downwardly over the ends 6, 8 of the carton 205. The first top panel 21 can be folded over the tops of the containers C, and the second top panel 25 can overlap the first top panel 21. In one embodiment, the second top panel 25 is glued to the main portion 34 and the distal portion 35 of the first top panel 21 by glue strips 111, 113. The third handle panel 175 can at least partially overlap the first handle panel 141 as shown in FIG. 8. In one embodiment, an upper edge 194 of the third handle panel 175 can overlap or be generally aligned with at least a portion of the lateral fold lines 143, 145 and/or 163, 165, and the fold line 137 can overlap or be generally aligned with at least a portion of the lateral fold lines 177, 176 when the handle 207 is in the closed or flat position of FIG. 8. The carton 205 could be otherwise erected without departing from the disclosure.

FIGS. 8 and 9 show the carton 205 formed of the blank 203. As illustrated, the carton 205 is substantially similar in form and function to the carton 5 described in detail above. The handle 207 is arranged on an upper or top portion of the carton 205, and may be actuated from a first position (FIG. 8) to a second position (FIG. 9) by first separating the third handle panel 175 and rotating it in a direction A1 (FIG. 8) and subsequently separating the first and second handle panels (i.e., reinforced portion 221) and rotating in a direction A2 (FIG. 8) to erect the handle 207 as illustrated in FIG. 9.

In one embodiment, the handle 207 includes the reinforced handle portion 221 and the third handle panel 75 that can be folded in the opposite directions illustrated by arrows A1 and A2 (FIG. 8) to extend upwards from the carton 205 when the handle is activated. In one embodiment, the reinforced handle portion may be erected to be orthogonal or angled relative to the carton 205, and the third handle panel 175 may be erected to be orthogonal or angled relative to the carton 205. As shown in FIG. 9, the handle flaps 152, 186 can be folded relative to the first handle panel 141 and the third handle panel 175 to at least partially overlap and to extend at least partially between the handle portion 221 and the third handle flap 175. The reinforced handle portion 221 and the third handle panel 175 could be otherwise shaped, arranged, and/or positioned (e.g., angled) without departing from the scope of the disclosure.

In general, the blanks described herein may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, the carton comprising:

a plurality of panels that extends at least partially around an interior of the carton, the plurality of panels comprising at least a top panel, wherein the top panel comprises a main portion and a distal portion, and the main portion at least partially overlaps the distal portion so that an exterior surface of the distal portion of the top panel is at least partially in face-to-face contact with an interior surface of the main portion of the top panel; and a handle being positionable between a first position and a second position, the handle comprising at least a first handle panel, a second handle panel, and an intermediate panel, the first handle panel being foldably connected to the main portion of the top panel, the second handle panel being foldably connected to the distal portion of the top panel, and the intermediate panel being foldably connected to the first handle panel and the second handle panel, wherein at least one of the first handle panel and the second handle panel is generally coplanar with at least a portion of the top panel in the first position of the handle, and each of the first handle panel and the second handle panel extends upwardly relative to the top panel and the first handle panel is spaced apart from the second handle panel in the second position of the handle;

wherein the exterior surface of the distal portion of the top panel is at least partially in face-to-face contact with an exterior surface of the second handle panel when the handle is in the first position.

2. The carton of claim 1, wherein the handle further comprises a third handle panel in face-to-face contact with the first handle panel or the second handle panel for reinforcing the first handle panel or the second handle panel, the first handle panel is foldably connected to the main portion of the top panel along a first fold line, and the second handle panel is foldably connected to the distal portion of the top panel along a second fold line.

3. The carton of claim 2, wherein the top panel is a first top panel, the plurality of panels further comprises a second top panel at least partially overlapping the first top panel, and the third handle panel is foldably connected to the second top panel along a third fold line.

4. The carton of claim 1, wherein the first handle panel is foldably connected to the main portion of the top panel along a first transverse fold line, the second handle panel is foldably connected to the distal portion of the top panel along a second transverse fold line, the intermediate panel is foldably connected to the first side panel along a third transverse fold line, and the intermediate panel is foldably connected to the second side panel along a fourth transverse fold line.

5. The carton of claim 1, wherein an interior surface of the second handle panel is at least partially in face-to-face contact with an interior surface of the intermediate panel and the first handle panel when the panel is in the first position, and the first handle panel and the second handle panel are for being folded upwardly with respect to the main portion and the distal portion of the top panel so that the intermediate panel extends generally horizontally between the first handle panel and the second handle panel when the handle is in the second position.

6. The carton of claim 1, wherein the handle further comprises a third handle panel overlapping the first handle panel or the second handle panel for reinforcing the first handle panel or the second handle panel.

7. The carton of claim 1, wherein the top panel is a first top panel, the plurality of panels further comprises a second top panel at least partially overlapping the first top panel, and the handle further comprises a third handle panel foldably connected to the second top panel.

8. The carton of claim 7, wherein the third handle panel is attached at least partially in face-to-face contact with the first handle panel for reinforcing the first handle panel.

9. The carton of claim 1, wherein the top panel is a first top panel, the plurality of panels further comprises a second top panel at least partially overlapping the first top panel, the main portion comprises at least one glue opening, and the distal portion is at least partially adhered to the second top panel through the at least one glue opening.

10. A carton for holding a plurality of articles, the carton comprising:

a plurality of panels that extends at least partially around an interior of the carton, the plurality of panels comprising at least a first top panel and a second top panel, the second top panel at least partially overlapping the first top panel, wherein the first top panel comprises a main portion and a distal portion, and the main portion at least partially overlaps the distal portion; and a handle being positionable between a first position and a second position, the handle comprising at least a first handle panel, a second handle panel, and a third handle panel, the first handle panel being foldably connected to the main portion of the first top panel, the second handle panel being foldably connected to the distal portion of the first top panel, and the third handle panel being foldably connected to the second top panel, wherein at least one of the first handle panel and the second handle panel is generally coplanar with at least a portion of the first top panel in the first position of the handle, and each of the first handle panel and the second handle panel extends upwardly relative to the first top panel and the first handle panel is spaced apart from the second handle panel in the second position of the handle;

wherein the second top panel is at least partially adhered to the main portion and the distal portion of the first top panel.

11. A carton for holding a plurality of articles, the carton comprising:

a plurality of panels that extends at least partially around an interior of the carton, the plurality of panels comprising at least a first top panel and a second top panel, wherein the first top panel comprises a main portion and a distal portion, and the main portion at least partially overlaps the distal portion so that an exterior surface of the distal portion of the first top panel is at least partially in face-to-face contact with an interior surface of the main portion of the first top panel, and wherein the second top panel at least partially overlaps the first top panel; and a handle being positionable between a first position and a second position, the handle comprising at least a first handle panel, a second handle panel, and a third handle panel, the first handle panel being foldably connected to the main portion of the top panel, the second handle panel being foldably connected to the second top panel, the third handle panel being foldably connected to the first handle panel and to the distal portion of the first top panel, and the first handle panel at least partially overlapping the third handle panel;

wherein at least one of the first handle panel and the second handle panel is generally coplanar with at least a portion of the first top panel in the first position of the handle;

wherein each of the first handle panel and the second handle panel extends upwardly relative to the first top panel in the second position of the handle, and the first handle panel is spaced apart from the second handle panel in the second position of the handle;

wherein the distal portion of the first top panel is at least partially in face-to-face contact with an exterior surface of the third handle panel when the handle is in the first position, and an interior surface of the third handle panel is at least partially in face-to-face contact with an interior surface of the first handle panel.

12. The carton of claim 11, wherein the first handle panel is foldably connected to the main portion of the top panel along a first fold line, the third handle panel is foldably connected to the distal portion of the top panel along a second fold line, and the first handle panel is foldably connected to the third handle panel along a third fold line.

13. The carton of claim 12, wherein the second handle panel is foldably connected to the second top panel along a fourth fold line, the second handle panel at least partially overlapping the first handle panel.

14. The carton of claim 11, wherein the second handle panel at least partially overlaps the first handle panel in the first position of the handle, and the first handle panel and the second handle panel are for being folded upwardly with respect to the first top panel and the second top panel in opposite directions when the handle is actuated to the second position.

15. The carton of claim 14, wherein the first handle panel is foldably connected to the first top panel along a first fold line, the second handle panel is foldably connected to the second top panel along a second fold line, the first fold line is spaced apart from the second fold line, and a top edge of the second handle panel at least partially overlays the first fold line in the first position of the handle.

16. A carton for holding a plurality of articles, the carton comprising:

a plurality of panels that extends at least partially around an interior of the carton, the plurality of panels comprising at least a top panel; and a handle being positionable between a first position and a second position, the handle comprising at least a first handle panel and a second handle panel, at least one of the first handle panel and the second handle panel being foldably connected to the top panel, wherein at least one of the first handle panel and the second handle panel is generally coplanar with at least a portion of the top panel in the first position of the handle, and each of the first handle panel and the second handle panel extends upwardly relative to the top panel and the first handle panel is spaced apart from the second handle panel in the second position of the handle;

wherein the top panel comprises a main portion and a distal portion, the main portion at least partially overlaps the distal portion, at least one locking tab is foldably connected to the main portion, and the at least one locking tab is folded downwardly at least partially through a locking opening in the distal portion to engage an underside of the distal portion.

17. A blank for forming a carton, the blank comprising:

a plurality of panels comprising at least a top panel, the top panel comprising a main portion and a distal portion, the main portion being for at least partially overlapping the distal portion when the carton is formed from the blank, wherein the distal portion of the top panel is separable from the main portion of the top panel along a cut line; and handle features for forming a handle that is positionable between a first position and a second position in the carton formed from the blank, the handle features comprising at least a first handle panel and a second handle panel, at least one of the first handle panel and the second handle panel being foldably connected to the top panel, wherein at least one of the first handle panel and the second handle panel is for being generally coplanar with at least a portion of the top panel in the first position of the handle in the carton formed from the blank, and each of the first handle panel and the second handle panel is for extending upwardly relative to the top panel and the first handle panel is for being spaced apart from the second handle panel in the second position of the handle in the carton formed from the blank.

18. The blank of claim 17, wherein the handle features further comprise a third handle panel for being disposed in face-to-face contact with the first handle panel or the second handle panel when the carton is formed from the blank, the first handle panel is foldably connected to the main portion of the top panel along a first fold line, and one of the second handle panel and the third handle panel is foldably connected to the distal portion of the top panel along a second fold line.

19. The blank of claim 18, wherein the top panel is a first top panel, the plurality of panels further comprises a second top panel for being positioned to at least partially overlap the first top panel when the carton is formed from the blank, and one of the second handle panel and the third handle panel is foldably connected to the second top panel along a third fold line.

20. The blank of claim 17, wherein the first handle panel is foldably connected to the main portion of the top panel and the second handle panel is foldably connected to the distal portion of the top panel.

21. The blank of claim 20, wherein the handle features comprise an intermediate panel that is foldably connected to the first handle panel and the second handle panel.

22. The blank of claim 21, wherein the first handle panel is foldably connected to the main portion of the top panel along a first transverse fold line, the second handle panel is foldably connected to the distal portion of the top panel along a second transverse fold line, the intermediate panel is foldably connected to the first side panel along a third transverse fold line, and the intermediate panel is foldably connected to the second side panel along a fourth transverse fold line.

23. The blank of claim 21, wherein the handle features further comprise a third handle panel for overlapping the first handle panel or the second handle panel when the carton is formed from the blank.

24. The blank of claim 21, wherein the top panel is a first top panel, the plurality of panels further comprises a second top panel for at least partially overlapping the first top panel when the carton is formed from the blank, and the handle features further comprise a third handle panel foldably connected to the second top panel.

25. The blank of claim 17, wherein the first handle panel is foldably connected to the main portion of the top panel along a first fold line, the handle features comprise a third handle panel foldably connected to the distal portion of the top panel along a second fold line, and the first handle panel is foldably connected to the third handle panel along a third fold line.

26. The blank of claim 25, wherein the top panel is a first top panel, the plurality of panels further comprises a second top panel for at least partially overlapping the first top panel when the carton is formed from the blank, and the second handle panel is foldably connected to the second top panel along a fourth fold line, the second handle panel is for at least partially overlapping the first handle panel when the carton is formed from the blank.

27. The blank of claim 17, wherein the top panel is a first top panel, the plurality of panels further comprises a second top panel for at least partially overlapping the first top panel when the carton is formed from the blank, the first handle panel is foldably connected to the first top panel, and the second handle panel is foldably connected to the second top panel.

28. The blank of claim 27, wherein the first handle panel is foldably connected to the first top panel along a first fold line, the second handle panel is foldably connected to the second top panel along a second fold line, the first fold line is for being spaced apart from the second fold line when the carton is formed from the blank, and a top edge of the second handle panel is for at least partially overlaying the first fold line when the carton is formed from the blank and the handle is in the first position.

29. The blank of claim 27, wherein the handle further comprises a third handle panel foldably connected to the first handle panel, and the first handle panel is for at least partially overlapping the third handle panel in the carton formed from the blank.

30. The blank of claim 29, wherein the third handle panel is foldably connected to the distal portion.

31. The blank of claim 17, wherein the top panel is a first top panel, the plurality of panels further comprises a second top panel for at least partially overlapping the first top panel when the carton is formed from the blank, the main portion comprises at least one glue opening, and the distal portion is for being at least partially adhered to the second top panel through the at least one glue opening when the carton is formed from the blank.

32. The blank of claim 17, wherein the handle further comprises a third handle panel for being disposed in face-to-face contact with the first handle panel for reinforcing the first handle panel when the carton is formed from the blank.

33. A blank for forming a carton, the blank comprising:

a plurality of panels comprising at least a top panel; and handle features for forming a handle that is positionable between a first position and a second position in the carton formed from the blank, the handle features comprising at least a first handle panel and a second handle panel, at least one of the first handle panel and the second handle panel being foldably connected to the top panel, wherein at least one of the first handle panel and the second handle panel is for being generally coplanar with at least a portion of the top panel in the first position of the handle in the carton formed from the blank, and each of the first handle panel and the second handle panel is for extending upwardly relative to the top panel and the first handle panel is for being spaced apart from the second handle panel in the second position of the handle in the carton formed from the blank;

wherein the top panel comprises a main portion and a distal portion, the main portion is for at least partially overlapping the distal portion when the carton is formed from the blank, at least one locking tab is foldably connected to the main portion, and the at least one locking tab is for being folded downwardly at least partially through a locking opening in the distal portion to engage an underside of the distal portion when the carton is formed from the blank.

34. A method of forming a carton comprising:

obtaining a blank comprising a plurality of panels comprising at least a top panel comprising a main portion and a distal portion, and handle features comprising at least a first handle panel and a second handle panel, at least one of the first handle panel and the second handle panel being foldably connected to the top panel, wherein the distal portion of the top panel is separable from the main portion of the top panel along a cut line;

forming an interior of the carton at least partially defined by the plurality of panels, the forming the interior of the carton comprising separating the distal portion of the top panel from the main portion of the top panel along the cut line and positioning the main portion of the top panel to at least partially overlap the distal portion of the top panel; and forming a handle from the handle features, the handle being positionable between a first position and a second position, wherein at least one of the first handle panel and the second handle panel is generally coplanar with at least a portion of the top panel in the first position of the handle, and each of the first handle panel and the second handle panel extends upwardly relative to the top panel and the first handle panel is spaced apart from the second handle panel in the second position of the handle.

35. The method of claim 34, wherein the handle features further comprise a third handle panel, the first handle panel is foldably connected to the main portion of the top panel along a first fold line, one of the second handle panel and the third handle panel is foldably connected to the distal portion of the top panel along a second fold line, and the forming the handle comprises positioning the third handle panel in face-to-face contact with the first handle panel or the second handle panel for reinforcing the first handle panel or the second handle panel.

36. The method of claim 35, wherein the top panel is a first top panel, the plurality of panels further comprises a second top panel, one of the second handle panel and the third handle panel is foldably connected to the second top panel along a third fold line, and the forming the interior of the carton further comprises positioning the second top panel to at least partially overlap the first top panel.

37. The method of claim 34, wherein the top panel is a first top panel, the plurality of panels further comprises a second top panel, the first handle panel is foldably connected to the first top panel, the second handle panel is foldably connected to the second top panel, the forming the interior of the carton comprises positioning the second top panel to at least partially overlap the first top panel, and the forming the handle comprises positioning the second handle panel to at least partially overlap the first handle panel in the first position of the handle, and the first handle panel and the second handle panel are for being folded upwardly with respect to the first top panel and the second top panel in opposite directions when the handle is actuated to the second position.

38. The method of claim 37, wherein the first handle panel is foldably connected to the first top panel along a first fold line, the second handle panel is foldably connected to the second top panel along a second fold line, and the positioning the second top panel to at least partially overlap the first top panel comprises disposing the first fold line to be spaced apart from the second fold line and positioning a top edge of the second handle panel to at least partially overlay the first fold line in the first position of the handle.

39. The method of claim 37, wherein the handle further comprises a third handle panel foldably connected to the first handle panel and the distal portion, and the forming the handle comprises positioning the first handle panel to at least partially overlap the third handle panel.

40. The method of claim 39, wherein the positioning the main portion of the first top panel comprises disposing the distal portion of the first top panel at least partially in face-to-face contact with an interior surface of the main portion of the first top panel and with an exterior surface of the third handle panel when the handle is in the first position, and the positioning the first handle panel comprises disposing an interior surface of the first handle panel at least partially in face-to-face contact with an interior surface of the third handle panel.

41. A method of forming a carton comprising:

obtaining a blank comprising a plurality of panels comprising at least a top panel comprising a main portion and a distal portion, and handle features comprising at least a first handle panel and a second handle panel, at least one of the first handle panel and the second handle panel being foldably connected to the top panel;

forming an interior of the carton at least partially defined by the plurality of panels, the forming the interior of the carton comprising positioning the main portion of the top panel to at least partially overlap the distal portion of the top panel; and forming a handle from the handle features, the handle being positionable between a first position and a second position, wherein at least one of the first handle panel and the second handle panel is generally coplanar with at least a portion of the top panel in the first position of the handle, and each of the first handle panel and the second handle panel extends upwardly relative to the top panel and the first handle panel is spaced apart from the second handle panel in the second position of the handle;

wherein the first handle panel is foldably connected to the main portion of the top panel and the second handle panel is foldably connected to the distal portion of the top panel, the handle features further comprise an intermediate panel that is foldably connected to the first handle panel and the second handle panel, and the forming the interior of the carton further comprises positioning the distal portion of the top panel so that an exterior surface of the distal portion is at least partially in face-to-face contact with an interior surface of the main portion of the top panel and with an exterior surface of the second handle panel when the handle is in the first position.

42. The method of claim 41, wherein the top panel is a first top panel, the plurality of panels further comprises a second top panel, the handle features further comprise a third handle panel foldably connected to the second top panel, the forming the interior of the carton further comprises positioning the second top panel to at least partially overlap the first top panel, and the forming the handle further comprises positioning the third handle panel to at least partially overlap the first handle panel.

43. A method of forming a carton comprising:

obtaining a blank comprising a plurality of panels comprising at least a top panel, and handle features comprising at least a first handle panel and a second handle panel, at least one of the first handle panel and the second handle panel being foldably connected to the top panel;

forming an interior of the carton at least partially defined by the plurality of panels; and forming a handle from the handle features, the handle being positionable between a first position and a second position, wherein at least one of the first handle panel and the second handle panel is generally coplanar with at least a portion of the top panel in the first position of the handle, and each of the first handle panel and the second handle panel extends upwardly relative to the top panel and the first handle panel is spaced apart from the second handle panel in the second position of the handle;

wherein the top panel comprises a main portion and a distal portion, the main portion comprises at least one glue opening and at least one locking tab foldably connected to the main portion, the forming the interior of the carton comprises positioning the main portion to at least partially overlap the distal portion, downwardly folding the at least one locking tab at least partially through a locking opening in the distal portion to engage an underside of the distal portion, and at least partially adhering the distal portion to the second top panel at least through the at least one glue opening.

* * * * *